United States Patent [19]

Dezoppy

[11] 4,039,179

[45] Aug. 2, 1977

[54] DEVICE FOR COLLATING SHEETS

[76] Inventor: Robert Dezoppy, 96, Rue Triolet, Angleur, Belgium

[21] Appl. No.: 625,774

[22] Filed: Oct. 24, 1975

Related U.S. Application Data

[63] Continuation-in-part of Ser. No. 464,191, April 25, 1974, abandoned.

[30] Foreign Application Priority Data

Apr. 25, 1973 Luxembourg ..... 67495

[51] Int. Cl.[2] ..... B65H 39/05

[52] U.S. Cl. ..... 270/58

[58] Field of Search ..... 270/58; 271/9, 110, 271/258; 221/13, 255

[56] References Cited

U.S. PATENT DOCUMENTS

| | | | |
|---|---|---|---|
| 2,856,187 | 10/1958 | Burckhardt | 271/258 X |
| 3,536,318 | 10/1970 | Gay et al. | 270/58 |
| 3,664,656 | 5/1972 | Ryland | 270/58 |
| 3,790,162 | 2/1974 | Halbert | 271/110 X |

FOREIGN PATENT DOCUMENTS

| | | | |
|---|---|---|---|
| 791,562 | 3/1958 | United Kingdom | 271/9 |

*Primary Examiner*—Edgar S. Burr
*Assistant Examiner*—A. Heinz

[57] ABSTRACT

Batches of sheets are arranged in the desired order in a series of parallel racks. Pushers simultaneously entrain the upper sheet of each batch and cause the upper sheets to protrude from the racks, ready for collection. The protruding sheets interrupt a light beam passing from an emitter to a photo-sensitive cell. The operation of the pushers is interrupted by a control means, including the photo-sensitive cell, upon interruption of the light beam.

6 Claims, 4 Drawing Figures

DEVICE FOR COLLATING SHEETS

This is a continuation-in-part of application Ser. No. 464,191 of R. Dezoppy, filed Apr. 25, 1974, entitled "Device for Collating Sheets," and now abandoned.

The invention relates to devices for collating sheets such as sheets of paper.

Devices or collating sheets such as sheets of paper are known per se. They usually consist of a number of racks placed adjacent to each other and containing the sheets which are to make up the fascicle, the sheets being arranged in batches of identical sheets in each rack.

Entraining pins are usually used to retrieve the sheets from the racks of these devices. The pins use friction push the upper sheet of each batch out of each rack, this sheet being intended to form part of a fascircle. fascicle.

Local labour conditions usually require that machines of this type be very small and that collection be as easy as possible, so it is advantageous to have the different sheets emerge simultaneously at the different rack outlet points for manual retrieval.

Devices of this type do exist but all have some disadvantages.

Continuously operating devices do not give the operator who is collecting the sheets sufficient time to ensure that each fascicle is complete. Nor do they allow the operator to correct a mistake, for example if one of the sheets does not project quickly enough from its rack or fails to project.

Intermittent devices, i.e. devices which the operator has to stop and start the device to collect the sheets making up the fascicle, suffer from the disadvantage of being very slow.

If the number of sheets to be collected from either of the devices above is even slightly above average, the operator has to constantly display a high level of skill either in continuously matching the rhythm of the machine without faltering or in maintaining a sufficiently high rate of production by rapid starting and stopping of the machine and collection of the sheets irrespective of his own tiredness, which will certain slow his working rhythm and thus that of the machine.

What is desired is a very simple device which offers an effective and practically foolproof way of overcoming the above-mentioned disadvantages.

The present invention provides a device for collating sheets, comprising:

a. a series of racks arranged substantially parallel to each other one above another, to receive respective batches of sheets, b. a plurality of pushers which are to rest on the respective batches, the pushers frictionally engaging the uppermost sheets only during movement of the pushers in one direction relative to the racks, the pushers running freely on the uppermost sheets during relative movement in the opposite direction;

c. drive means for reciprocating the pushers simultaneously and in synchronism; and d. control means or automatically stopping and starting the drive means, the control means stopping the drive means when sheets project from the racks ready for collection and starting the drive means when the projecting sheets have been collected, the control means including a light emitter which directs a light beam past the series of racks, the beam being interrupted when a sheet projects from any of the racks, and a photo-sensitve cell in the path of the light beam beyond the series of racks.

In a preferred embodiment, the collating device includes delay means or delaying the stopping of the drive means until the sheets have projected further from the racks after interrupting the light beam. This facilitates collection of the sheets, while allowing the light emitter and photocell to be mounted close to the racks. The delay means could comprise a timing circuit, but preferably it comprises a switch actuated only when the pushers are at their forward position.

The design of the pushers allows the protruding sheets to be withdrawn disturbing the drive means. Preferably, each pusher comprises a rotatable member which frictionally engages the uppermost sheet upon rotation in one direction and which runs freely relative to the uppermost sheet upon rotation in the opposite direction.

The operation of the device is thus very simple. It stops automatically when protrude from the racks. All the operator has to do is to collect the protruding sheets by hand; the device starts to operate again as soon as all the sheets have been retrieved and thus no longer interrupt the light beam. The device will stop again after the sheets protrude from the racks and interrupt the light beam again.

The invention will be described further, by way of example only, with reference to the accompanying drawings, in which.

Figure 1:
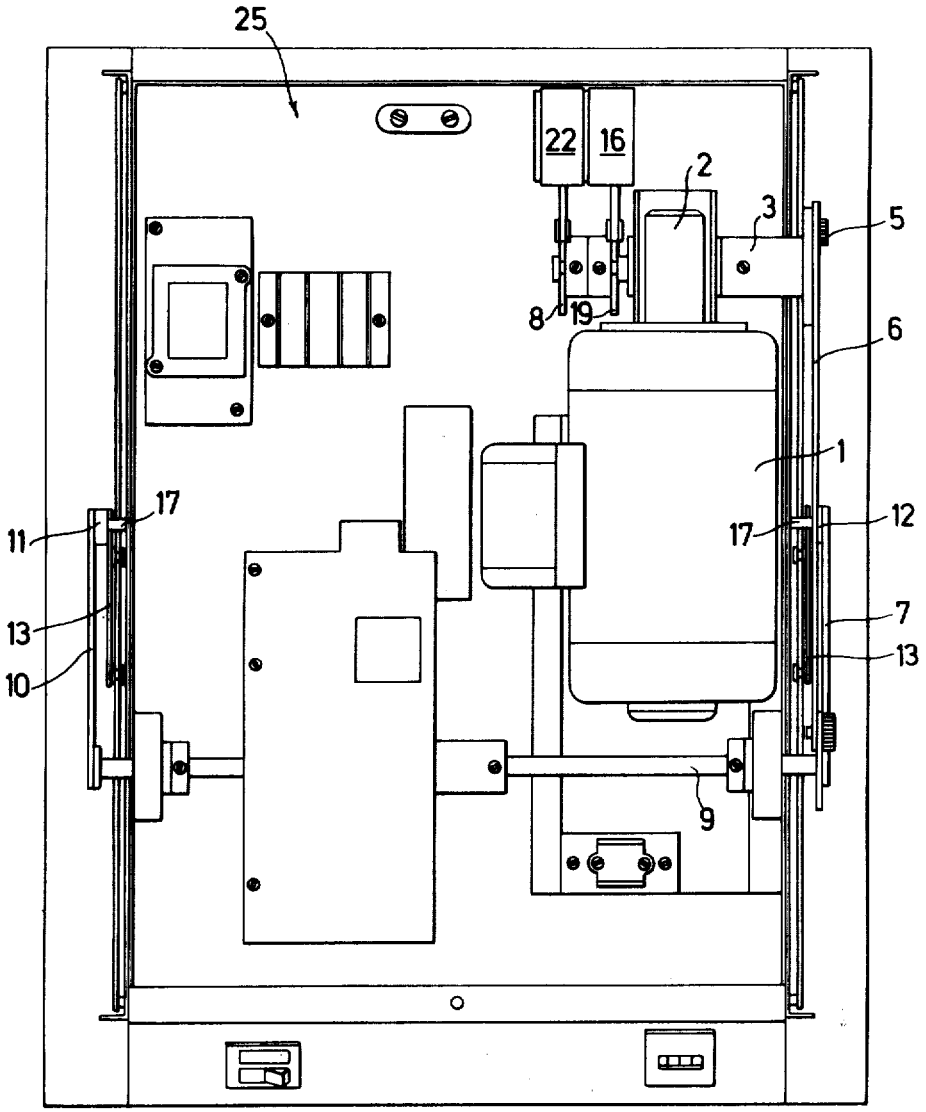
FIG. 1 is a plan view of a collating device.

The illustrated collating device has a housing 25 containing parallel horizontal racks 26 on which batches of sheets are to rest. A pusher 38 acts on the uppermost sheet in each batch and is hinged to one of a vertical series of parallel horizontal rods 17 whose ends are journalled in vertical bars 11 and 12. Each bar 11, 12 is fixed on a carriage 13 which runs along a horizontal rail 15.

Through a reducing gear 2, an electric motor 1 turns an eccentric 5, mounted on a shaft 3, which causes an arm 6 to move to and fro. The arm 6 is pivotally connected to the upper end of a lever 7 fixed on an axle 9; a lever 10 similar to the lever 7 is also fixed on the axle 9, so that the two levers 7, 10 oscillate in synchronism. The lower ends of the levers 7, 10 are linked to the respective bars 12, 11 by links 14, so that the bars move back and forth.

Figure 2:
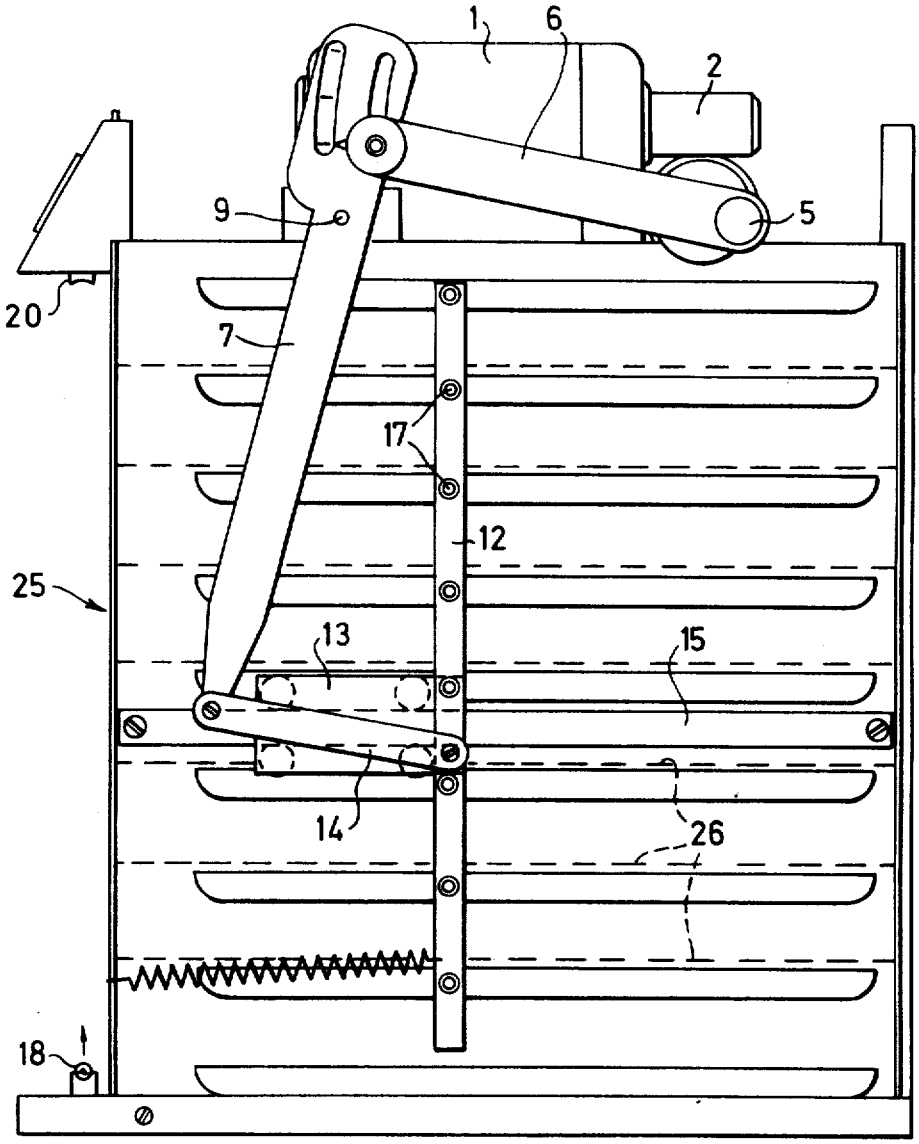
FIG. 2 is a side view of the collating device.

During the leftward movement of the bars 11, 12 as viewed in FIG. 2, the pushers 38 each eject a sheet partially from the respective racks 26. The motor 1 is then stopped, as explained below. Each pusher 38 comprises an arm 29 mounted on the rod 17. At the lower end of the arm 39 a pair of shoes 41 are mounted on an axle 40. The shoes 41 have rearwardly cut-out portions 43. In the front end of each shoe 41 a spongy friction pad 44 is mounted and extends from the bottom of the shoe. Upon movement of the pusher 38 to the left (FIG. 2) the shoes 41 will, via their pads 44, frictionally engage the uppermost sheet and partially eject it from the rack. Upon relative movement in the opposite direction (either when the sheet is withdrawn by hand or when the pusher moves rightwards) the shoes 41 will tilt about the axle 40 until they rest against a stop 45, whereupon the cut-out portions 43 will slide along the sheet.

Alternatively, the feet 41 may be replaced by a ratchet wheel, or by a roller whose turning is limited and which is smooth over one part of its circumference and rough over the other part.

Figure 3:
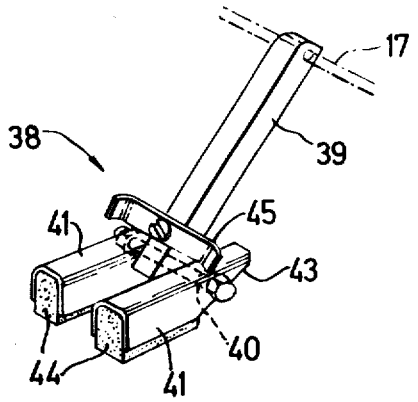
FIG. 3 is a perspective view of a pusher in the collating device.
Figure 4:
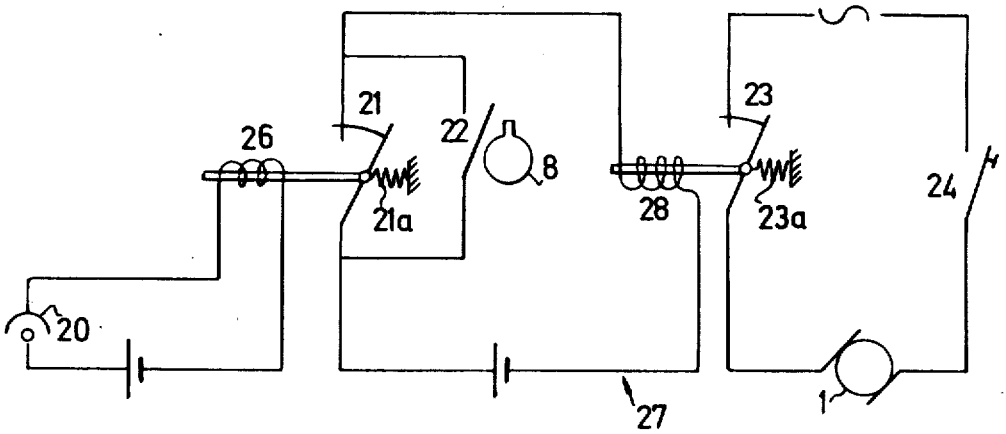
FIG. 4 is a diagram of the electrical control circuit of the collating device.
Figure 4:
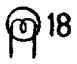

The sheets projecting from the racks are collected by the operator while the motor 1 is inactive. The starting and stopping of the motor is performed automatically by a control circuit. A lamp 18 directs a beam vertically upwards past the front edges of all the racks 26 throughout the operation of the collating device. The light beam falls on a photoelectric cell 20 so long as no sheets project from the rack 26. The shaft 3 (FIG. 1), on which the eccentric 5 is mounted, also carries a cam 8, which opens a switch 22 whenever the pushers 38 (FIG. 3) are at their front positions, in which the sheets project from the racks. The control circuit is shown in FIG. 4 and includes the photocell 20 and the switch 22.

To start the collating device, an on-off switch 24 in series with the motor 1 is closed, and the lamp 18 is switched on. Consequently, the photo-cell 20 is energised and allows current to pass through a solenoid 26 which closes a switch 21 in a relay circuit 27. (The switch 22 is normally closed, and is opened by the cam 8 only when the pushers 38 reach their forward positions.) Closure of the switch 21 allows current to pass through a solenoid 28 which closes a switch 23 in series with the motor 1 and the switch 24 (closed). Thus the motor 1 starts and, consequently, the pushers 38 are moved forwards, carrying with them the uppermost sheet of each of the batches on the racks 26.

As soon as the sheets project sufficiently to interrupt the light beam, the photo-cell 20 is de-energized and current ceases to flow through the solenoid 26, whereupon the switch 21 opens under the action of a spring 21*a*. However, the switch 22 (in parallel with the switch 21) remains closed, so that current still flows through the solenoid 28. Not until the pushers 38 are at their front positions does the cam 8 open the switch 22, at which time the sheets project from the racks sufficiently to facilitate collection by the operator. The switches 21, 22 being open, current ceases to flow through the solenoid 28, the switch 23 opens under the action of a spring 23*a*, and the motor 1 stops.

The operator collects the protruding sheets by hand. As soon as all the protruding sheets have been collected, the light beam from the lamp 18 again energises the photo- cell 20, and the above-described is repeated.

As well as the cam 8, the shaft 3 carries a cam 19 which periodically actuates a switch 16 controlling a circuit which counts the number of sheets ejected from the racks.

I claim:

1. A device for collating sheets, comprising:

a. a series of racks arranged substantially parallel to each other one above another, to receive respective patches of sheets each rack having a front entrance for allowing sheets to be projected out of the respective racks;

b. a plurality of pushers which are to rest on the respective batches, the pushers frictionally engaging the uppermost sheets and pushing said uppermost sheets into a projecting position only during movement of the pushers in one direction relative to the racks, wherein the projected upper most sheets are the pushers running freely on the uppermost sheets during relative movement in the opposite direction;

c. drive means for reciprocating the pushers simultaneously and in synchronism; and d. control means for automatically stopping the drive means when sheets project from the racks ready for manual collection and starting the drive means when the projecting sheets have been collected, the control means including a light emitter which directs a light beam past the series of racks, and a photo-sensitive cell in the path of the light beam beyond the series of racks whereby the beam is interrupted when a sheet projects from any of the racks.

2. The collating device as claimed in claim 1, further comprising delay means for delaying the stopping of the drive means until the sheets have projected further from the racks after interrupting the light beam.

3. The collating device as claimed in claim 2, wherein the delay means comprises a switch which is actuated to allow stopping of the drive means only when the pushers are at an extreme forward position during reciprocation.

4. The collating device as claimed in claim 3, further comprising a cam rotating in synchronism with the drive means, said switch being actuated once during each revolution of the cam.

5. The collating device as claimed in claim 1, wherein the drive means comprises an eccentric, a lever having two ends, one end linked to the eccentric, a bar linked to the other end of said lever, and guide means for guiding the bar for motion parallel to the racks, the pushers being connected to the bar.

6. The collating device as claimed in claim 1, wherein each pusher comprises a rotatable member which frictionally engages the uppermost sheet upon rotation in one direction and which runs freely relative to the uppermost sheet upon rotation in the opposite direction.

* * * * *